US005964175A

United States Patent [19]

Sirmalis et al.

[11] Patent Number: 5,964,175

[45] Date of Patent: Oct. 12, 1999

[54] CONFORMAL DETACHABLE PLATFORM ARRAY

[75] Inventors: John E. Sirmalis, Barrington; Bernard J. Myers, Bristol, both of R.I.

[73] Assignee: The United States of America as represented by the Secretary of the Navy, Washington, D.C.

[21] Appl. No.: 08/936,785

[22] Filed: Sep. 25, 1997

[51] Int. Cl.[6] ..... B63G 8/28; B63G 8/37; F41F 3/10; H01Q 1/34

[52] U.S. Cl. ..... 114/258; 114/238; 114/316; 114/318; 114/319; 114/322; 89/1.809; 89/5; 343/710

[58] Field of Search ..... 89/5, 1.809, 1.81; 114/238, 239, 316, 318, 319, 322, 323, 324, 325, 258, 259; 343/709, 710, 719

[56] References Cited

U.S. PATENT DOCUMENTS

| | | | |
|---|---|---|---|
| 841,981 | 1/1907 | Gray | 114/321 |
| 1,747,886 | 2/1930 | Bechard | 114/259 |
| 1,840,094 | 1/1932 | Hatch | 114/322 |
| 2,272,952 | 2/1942 | Reed, Jr. | 114/325 |
| 2,332,549 | 10/1943 | Baer | 114/322 |
| 4,147,124 | 4/1979 | Brooks et al. | 114/321 |
| 4,200,873 | 4/1980 | Seeley | 343/710 |
| 5,363,791 | 11/1994 | Stallard, III | 114/318 |
| 5,434,584 | 7/1995 | Kelly | 343/710 |
| 5,448,941 | 9/1995 | Godfrey et al. | 89/1.809 |
| 5,666,897 | 9/1997 | Armstrong | 114/20.1 |
| 5,734,121 | 3/1998 | Balzarini | 114/21.3 |
| 5,749,312 | 5/1998 | Hillenbrand et al. | 114/21.2 |

*Primary Examiner*—Charles T. Jordan
*Assistant Examiner*—Christopher K. Montgomery
*Attorney, Agent, or Firm*—Michael J. McGowan; Robert W. Gauthier; Prithvi C. Lall

[57] ABSTRACT

The invention provides a system for attaching one or more unmanned, hydrodynamically shaped, autonomous, undersea platforms to the bow of a submarine. An array of depressions, each matching the shape of the platforms, is provided in the bow of the submarine, equally spaced about the circumference of the submarine. Once seated in the depressions and attached to the submarine, the platforms provide a smooth, hydrodynamic shape to the bow of the submarine. Additionally, conformal arrays on the platforms mate with conformal arrays on the bow of the submarine to form a continuous conformal array and the platforms' weapons systems provide the submarine with forward deployed weapons when the platforms are attached. A platform is launched by detaching it from the submarine bow and raising the leading edge of the platform slightly into the water flow around the bow. Hydrodynamic forces lift the platform away from the submarine for an acoustically quiet launch.

11 Claims, 3 Drawing Sheets

CONFORMAL DETACHABLE PLATFORM ARRAY

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to undersea vehicles, and more particularly to a system for integrating an autonomous, unmanned undersea platform vehicle with a submarine's hull, conformal acoustic arrays and weapons systems.

(2) Description of the Prior Art

To meet increasing budgetary constraints while increasing operational capabilities of planned submarines, the use of autonomous platforms, launched from the submarine and capable of extended mission execution without tethered communication with the submarine, is being pursued. Such platforms would be unmanned, undersea vehicles (UUV's) having extensive sensor, communications and weapons capabilities and would be controlled through advanced autonomous data processing contained within the platform. While such a platform could be carried as an appendage to the submarine and launched by simply detaching from its mounting point, the integration of the platform with an advanced submarine presents a unique set of problems which need to be addressed. Advanced submarines contemplate a hydrodynamically shaped bow structure and sail to minimize drag. Appending an autonomous platform to this streamlined shape would defeat the hydrodynamic shaping. Additionally, the advanced submarine replaces the large spherical array of present submarines with large area conformal arrays, i.e., arrays which conform to the shape of the submarine while providing narrower acoustic beams and better noise rejection. Again, appending a platform to such a submarine would significantly decrease conformal array performance. Further, the space freed from the use of conformal arrays in advanced submarines versus the spherical array of traditional submarines allows weapons systems in advanced submarines to be more forward deployed. Any attachment of a platform to such an advanced submarine requires the integration of these components. Still further, the launch of the UUV must be acoustically quiet such that the location of the submarine is not revealed to hostile forces. Finally, the integration of the UUV with the submarine must be designed such that neither the submarine's hydrodynamic noise signature nor its acoustic target strength signature are raised following launch of the UUV from the submarine.

Current submarines do not typically employ or deploy UUV's, hence there are no known systems or methods for hydrodynamically attaching a UUV to a submarine. Similarly, UUV's carried aboard surface ships are normally deck mounted and lowered over the side such that hydrodynamically attaching the UUV to the ship is not a consideration. The prior art does teach the attachment of escape pods or compartments to submarines such that the attached pods or compartments conform with the outer hull of the submarine. For example, U.S. Pat. No. 3,107,641 to Haynes discloses an escape compartment which forms part of the deck structure of the submarine when attached to the submarine. However, the Haynes compartment and other similar escape pods do not provide the conformal array and weapons systems needed for the compartment or pod to serve as an adjunct to the submarine, nor do they provide for integrating such systems with those of the submarine. Further, the Haynes compartment utilizes explosives to launch the compartment from the submarine, quickly revealing the submarine's presence to a hostile force.

SUMMARY OF THE INVENTION

Accordingly, it is an object of the present invention to provide a system to hydrodynamically attach one or more UUV's to a submarine.

Another object of the present invention is to provide a system to attach one or more autonomously operating undersea platform vehicles to a submarine which integrates the platform's conformal arrays with the conformal arrays of the submarine.

Still another object of the present invention is to provide a system to attach one or more autonomously operating undersea platform vehicles to a submarine which integrates the platform's weapons systems with the submarine's weapons systems.

A further object of the present invention is to provide a system to attach one or more autonomously operating undersea platform vehicles to a submarine which allows for an acoustically quiet launch of the platform.

A still further object of the present invention is to provide a system to attach one or more autonomously operating undersea platform vehicles to a submarine which maintains a quiet hydrodynamic submarine signature and does not significantly alter the submarine's operating envelope while one or more of the autonomously operating undersea platform vehicles are detached from the submarine.

Other objects and advantages of the present invention will become more obvious hereinafter in the specification and drawings.

In accordance with the present invention, a system for attaching one or more unmanned, autonomous undersea platform vehicles to a submarine is provided having an array of conformal, detachable platform vehicles, or UUV's, distributed about the circumference of in the bow of a submarine. The configuration of the present invention provides for the attachment of four UUV's, while maintaining the hydrodynamic form of the submarine, providing a continuous conformal array and allowing the forward deployment of weapons. An array of depressions is provided in the bow of the submarine, about the longitudinal axis of the submarine. The depressions are shaped to accommodate the hydrodynamic shape of the UUV's. Once seated in the depressions, the UUV's provide a smooth, hydrodynamic shape to the bow of the submarine. Additionally, the conformal arrays of the UUV's mate with the conformal arrays on the bow of the submarine to form a continuous conformal array when the UUV's are attached to the submarine. Once attached, the UUV's weapons systems provide the forward deployed weapons of the submarine. A UUV can be launched by first severing its connections with the submarine bow. With the submarine underway, providing a slight angle, or tilt, of the UUV with respect to the submarine will permit hydrodynamic forces acting on the UUV shape to lift the UUV away from the submarine, allowing a "swim out" launch from the submarine. The depression, or depressions, that exist on the submarine bow when one or more UUV's are deployed are hydrodynamically designed to have minimal impact on submarine hydrodynamics and to have minimum flow separation, cavitation, or vortex shedding from the cavity edge, eliminating the need for bladders or doors to close over the cavity when the UUV's are deployed. The cavity shaping will also enable a clean return of the platform to the submarine with approach, closure and reattachment taking place in a stable hydrodynamic flow field while the submarine is moving forward at a reasonable speed.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
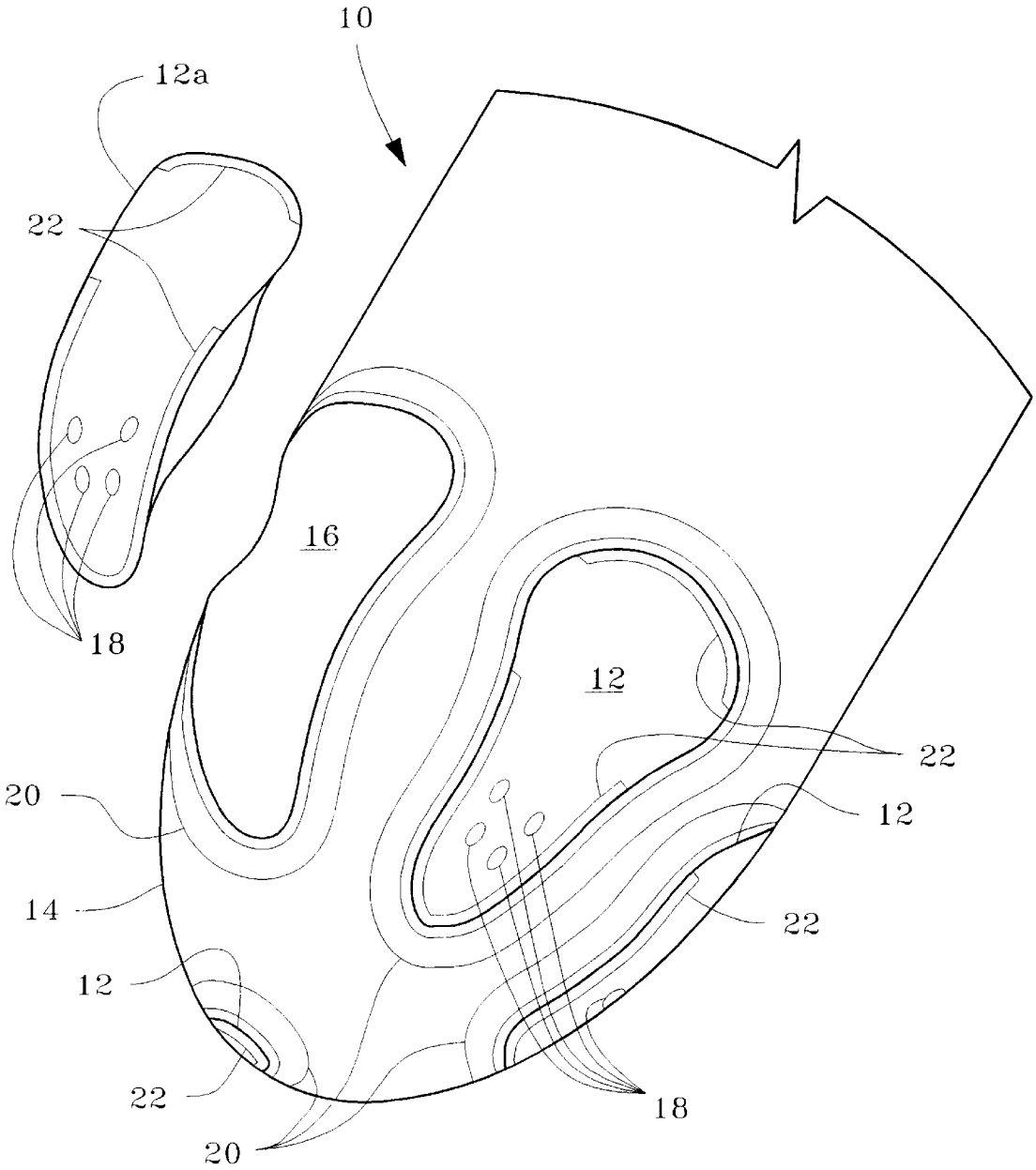
FIG. 1 is a schematic representation of the conformal detachable platform array system of the present invention on the bow of a submarine.

Referring now to FIG. 1, there is shown a schematic partial representation of a submarine 10 having a plurality of unmanned, autonomous, undersea platforms 12 attached to a bow portion 14 of submarine 10. Undersea platforms 12 serve as adjuncts to submarine 10 to extend the sphere of influence of submarine 10 when launched from submarine 10. FIG. 1 depicts one such launched platform 12*a* separated from submarine 10. Platforms 12 and launched platform 12*a* are hydrodynamically shaped to minimize noise and wake during operation. Depression 16 on bow portion 14 is shaped to accommodate launched platform 12*a* when launched platform 12*a* returns to submarine 12. Platforms 12 are shown within their respective depressions. In addition, it can be seen from FIG. 1 that bow portion 14 is further shaped so as to have an overall hydrodynamic shape when platforms 12 are attached within their depressions. To serve as forward deployed adjuncts of submarine 10, weapons systems 18 are incorporated into platforms 12 and launched platform 12*a*. Weapons systems 18 include short and long range defensive weapons and countermeasures as well as offensive weapons, with platforms 12 and launched platform 12*a* sized to accommodate advanced high speed and covert launched torpedoes. Communications between submarine 10 and platforms 12 and launched platform 12*a* allow weapons systems 18 to serve as the forward deployed weapons systems for submarine 10 with submarine 10 able to fire weapons systems 18 whether or not platforms 12 and launched platform 12*a* are attached to submarine 10. Since depressions 16 do not allow the placement of a typical sonar dome within bow portion 14, submarine 10 is provided with conformal arrays 20 about bow portion 14. Arrays 20 mate with platform arrays 22 to provide a coherent conformal array system when platforms 12 are attached to submarine 10 within depression 16.

Figure 2:
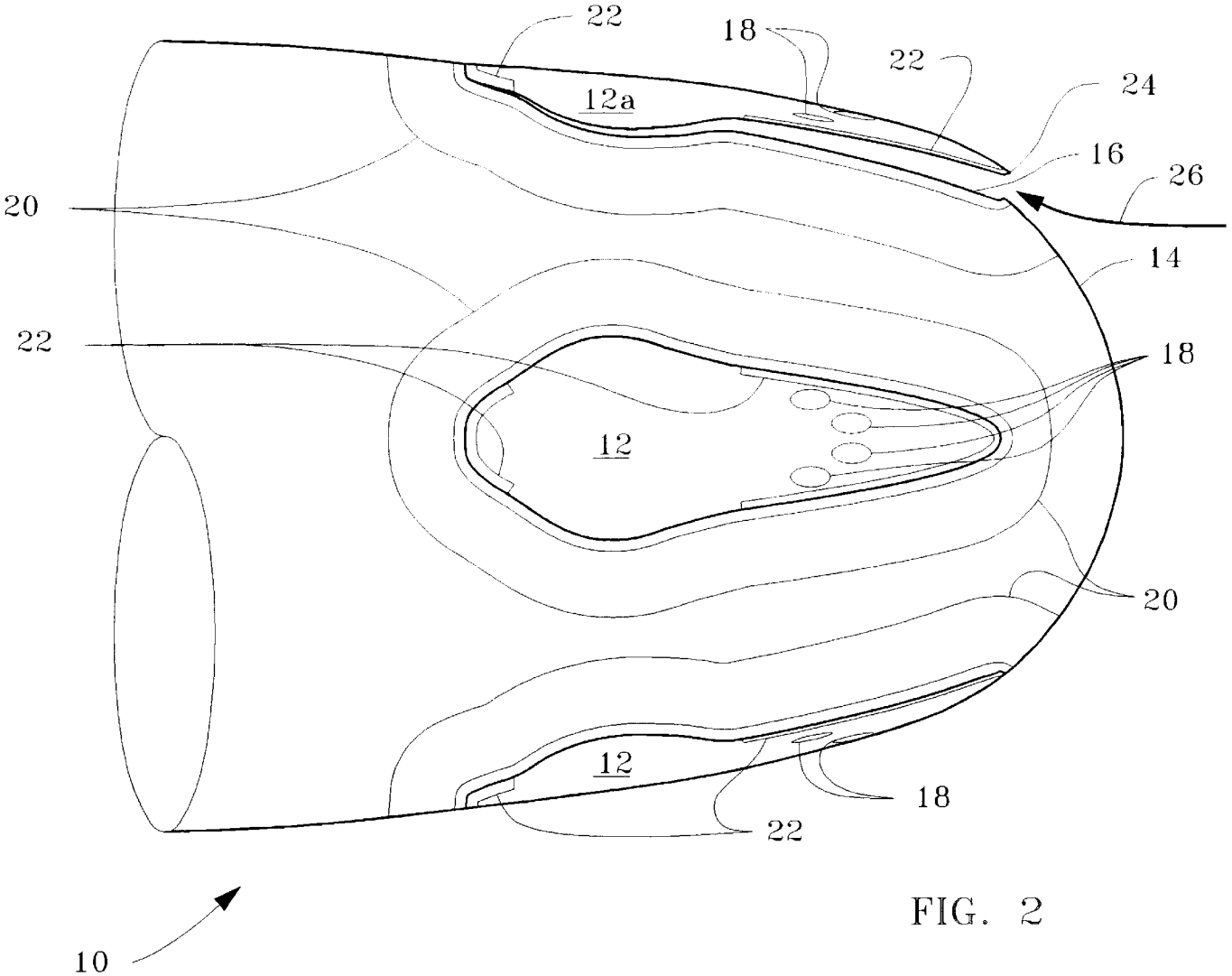
FIG. 2 is a side view of the conformal detachable platform array system of the present invention on the bow of a submarine.

Referring now to FIG. 2, a side view of bow portion 14 of submarine 10 is shown. Launched platform 12*a* is shown at the beginning of the launch cycle. With submarine 10 underway, launched platform 12*a* is detached from bow portion 14 to allow leading edge 24 of launched platform 12*a* to extend up from depression 16 and into the flow around bow portion 14, shown by line 26. The interaction of flow 26 with the hydrodynamic shape of launched platform 12*a* is such as to lift launched platform 12*a* away from bow portion 14.

Figure 3:
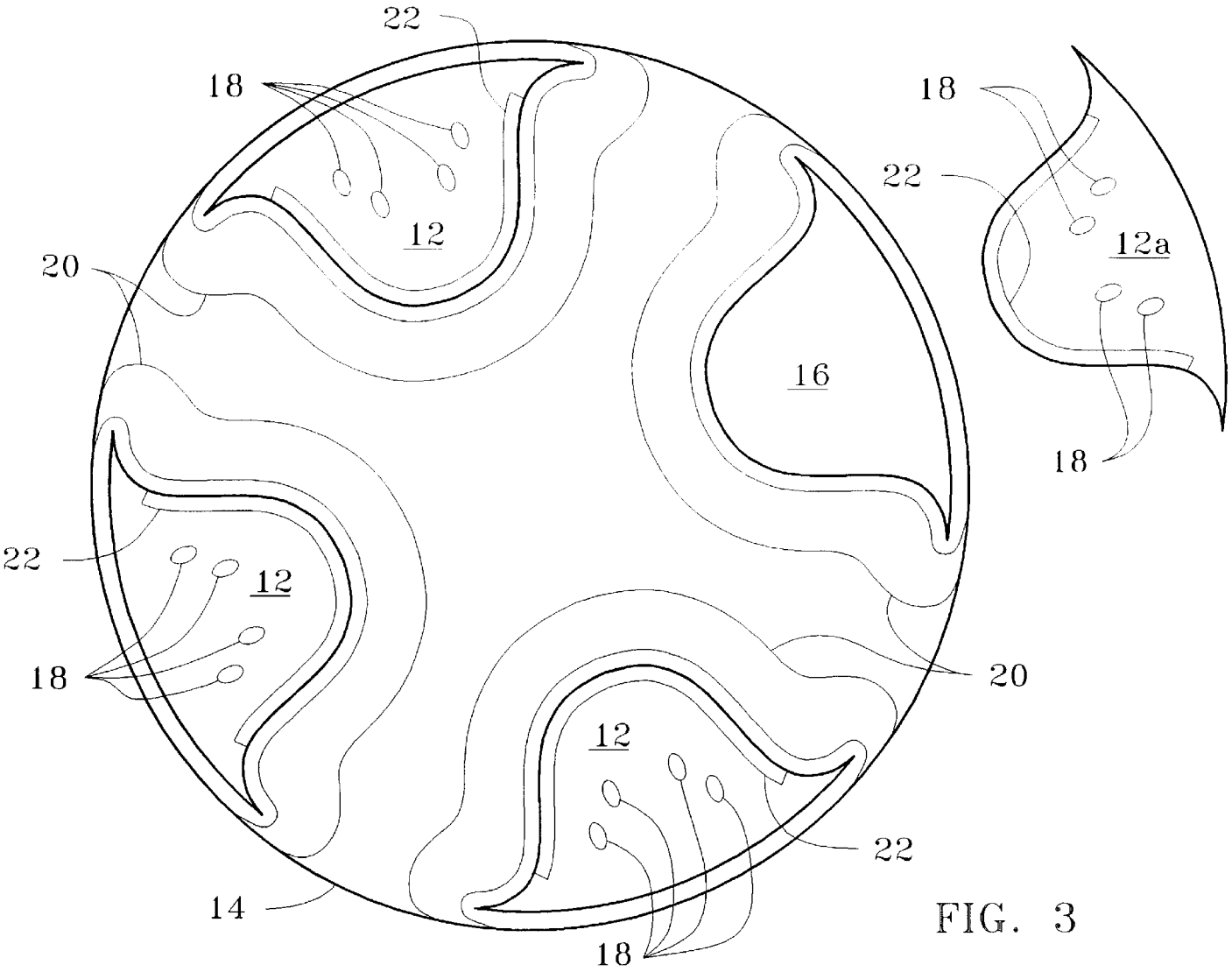
FIG. 3 is a front view of the conformal detachable platform array system of the present invention on the bow of a submarine.

FIG. 3 shows a front view of bow portion 14 which can accommodate four platforms 12. Launched platform 12*a* is shown distant from bow portion 14 and illustrates the complimentary shapes of launched platform 12*a* and depression 16. In operation, launched platform 12*a* may travel autonomously a considerable distance from submarine 10 to extend the sphere of influence of submarine 10 into areas submarine 10 may be incapable of entering, such as shallow water, or littoral, areas. Unmanned launched platform 12*a* may be directed to a hostile environment and, with weapons systems 18, be capable of taking offensive or defensive action to neutralize a threat, thus providing extended protection for personnel aboard submarine 10. Conformal arrays 20 and 22 and other sensors and antennas 28 (FIGS. 1 and 2) aboard submarine 10 and launched platform 12*a* provide environmental data and communication of that data between submarine 10 and launched platform 12*a*.

The invention thus described provides a system to hydrodynamically attach one or more unmanned, autonomous undersea platforms to the bow of a submarine. Depressions are shaped in the bow which match the hydrodynamic shape of the platforms. The depressions are spaced equally about the circumference of the submarine to accommodate a plurality of platforms. The bow itself is shaped such that, when the platforms are fitted within the depressions, the bow has a smooth hydrodynamic shape. When a platform is launched from the submarine, the shape of the depression is such that there is minimum flow separation, cavitation, or vortex shedding from the edge of the depression. This eliminates the need for doors or bladders to cover the depression when a platform is launched. With the submarine underway, launching of a platform is accomplished by raising a leading edge of a platform into the flow surrounding the bow. The flow lifts the platform from the depression, resulting in an acoustically quiet launch. Raising of the leading edge can be accomplished by any well known means such as hydraulics 30. Re-attaching a platform to the submarine is also accomplished by any well known means such as a robotic arm, grappling hooks or winches. When the submarine is still, the acoustically quiet propulsion units of the platform provide the lift necessary for the platform to clear the submarine. Conformal arrays in the bow and surrounding the depressions are contiguous and mate with conformal arrays on attached platforms to provide a continuous conformal array in the bow of the submarine which replaces current well known sonar domes. Weapons systems aboard the platforms serve as an integral part of the submarine's weapons systems when the platforms are attached and can be directly launched by the submarine's combat control system. Communications between the submarine and the platforms allows the submarine control over the platforms'weapons systems.

Although the present invention has been described relative to a specific embodiment thereof, it is not so limited. For example, FIGS. 1–3 show an array of four platforms. The number of platforms arrayed in the submarine bow can be varied depending on the relative sizes of the submarine and the platforms. Further, launch of the platform has been described using hydraulic lifts to raise the platform edge into the flow and using grappling hooks and winches to secure the platforms. As an alternative to these devices, electromagnets 30*a* (shown in FIG. 2) located within the platforms and within the depressions can be used to secure the platforms to the submarine. Reversing the poles results in a repulsive force which lifts the platforms away from the submarine.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for hydrodynamically attaching at least one unmanned, undersea platform to an outer surface of a submarine, the system comprising:

at least one depression in the outer surface corresponding to the at least one platform, the at least one depression shaped to receive and mate with the at least one platform, a peripheral edge of the at least one depression conforming to an outer edge of the at least one platform, the outer surface of the submarine in combination with an exposed surface of the at least one platform providing a smooth hydrodynamic shape when the at least one platform is within the at least one depression, the at least one depression further shaped to maintain an acoustically quiet hydrodynamic noise signature of the submarine and to minimize flow separation, cavitation and vortex shedding from the peripheral edge when the at least one platform is detached from the submarine; and a lifting means for exposing a leading edge of the at least one platform to a fluid flow about the submarine when the at least one platform is within the at least one depression, the flow further lifting the at least one platform out of the at least one depression.

2. The system of claim 1 wherein:

the at least one depression is located in a bow portion of the submarine; and the at least one depression is equally spaced about a circumference of the submarine.

3. The system of claim 1 further comprising a submarine conformal sonar array on the outer surface, the array mating with a platform conformal sonar array on the at least one platform when the at least one platform is within the at least one depression, the submarine conformal sonar array and the platform conformal sonar array forming a continuous conformal sonar array.

4. The system of claim 1 further comprising untethered communications means between the submarine and the at least one platform.

5. The system of claim 4 wherein the communications means controls operation of a weapons system on the at least one platform to provide the submarine with a forward deployed weapons system.

6. The system of claim 1 wherein the submarine controls a weapons system operation on the at least one platform to provide the submarine with a forward deployed weapons system.

7. The system of claim 1 wherein the lifting means comprises a hydraulic actuator.

8. The system of claim 1 wherein the lifting means comprises:

a first electromagnet located in the at least one depression; and a second electromagnet located in the least one platform, activation of the first and second electromagnets causing a repulsive force between the at least one depression and the at least one platform.

9. A system for hydrodynamically attaching more than one unmanned, undersea platform to an outer surface of a submarine, the system comprising:

more than one depression in a bow portion of the outer surface corresponding to the more than one platform, each depression shaped to receive one platform, the outer surface shaped to provide a smooth hydrodynamic shape in combination with the at least one platform within the at least one depression, the depressions arrayed about a circumference of the submarine;

a submarine conformal sonar array on the outer surface, the array mating with a platform conformal sonar array on the more than one platform when the platforms are within the depressions, the submarine conformal sonar array and the platform conformal sonar array forming a continuous conformal sonar array;

untethered communications means between the submarine and the platforms, the communications means providing control of weapons systems on the platforms; and a lifting means for exposing a leading edge of the more than one platform to a fluid flow about the submarine when the more than one platform is within the more than one depression, the flow further lifting the more than one platform out of the more than one depression.

10. The system of claim 9 wherein the more than one depression is further shaped to minimize flow separation, cavitation and vortex shedding from an edge of the more than one depression.

11. The system of claim 9 wherein the more than one depression is further shaped to maintain an acoustically quiet hydrodynamic noise signature of the submarine when at least one of the more than one unmanned, undersea platforms is detached from the submarine.

* * * * *